US006722176B2

(12) United States Patent
Cerrano et al.

(10) Patent No.: US 6,722,176 B2
(45) Date of Patent: Apr. 20, 2004

(54) METHODS AND APPARATUS FOR PERFORMING EMERGENCY EXTRICATIONS

(76) Inventors: Jason Cerrano, #3 Lakeview Dr., Rolla, MO (US) 65401; Todd Metzger, 2314 E. Lunar, Republic, MO (US) 65738

( * ) Notice: Subject to any disclaimer, the term of this patent is extended or adjusted under 35 U.S.C. 154(b) by 7 days.

(21) Appl. No.: 10/125,202

(22) Filed: Apr. 18, 2002

(65) Prior Publication Data

US 2003/0196470 A1 Oct. 23, 2003

(51) Int. Cl.[7] ..... B21D 1/12
(52) U.S. Cl. ..... 72/308; 72/392; 72/705
(58) Field of Search ..... 72/308, 392, 454, 72/705; 254/133 R

(56) References Cited

U.S. PATENT DOCUMENTS 1,159,906 A * 11/1915 Dewees ..... 254/231
1,703,992 A * 3/1929 Dawley ..... 72/705
2,165,503 A * 7/1939 Pfauser ..... 72/705
2,718,253 A * 9/1955 Zinke ..... 72/705
4,736,927 A * 4/1988 Clancy ..... 72/705
5,289,711 A * 3/1994 Spiegel ..... 72/705
6,311,537 B1 * 11/2001 Vigil ..... 72/705

* cited by examiner

*Primary Examiner*—Lowell A. Larson
(74) *Attorney, Agent, or Firm*—Robert B. Reeser, III

(57) ABSTRACT

A rescue tool is for use with emergency extrications from a structure. The tool includes a shaft and a pair of arms coupled to the shaft. The shaft has an axis of symmetry, and the pair of opposing arms include a first arm and a second arm. At least one of the first arm and the second arm is slidably coupled to the shaft and is configured to move along the shaft in a direction that is substantially parallel to the shaft axis of symmetry. Each of the arms includes an inner face and an outer face. At least one of the arm inner and outer faces includes a plurality of teeth configured to contact the structure. At least one of the first arm and the second arm extends substantially perpendicularly to the shaft.

52 Claims, 6 Drawing Sheets

METHODS AND APPARATUS FOR PERFORMING EMERGENCY EXTRICATIONS

BACKGROUND OF THE INVENTION

This invention relates generally to rescue tools and more particularly, to methods and apparatus for performing emergency extrications.

The purpose of an emergency extrication is to remove an injured victim from a damaged structure, in an orderly and efficient manner that does not facilitate increasing injuries to the victim. Powered portable rescue tools, such as the "POWER HAWK®" which is manufactured and sold by Curtiss Wright Flight Systems, Inc., of Fairfield, N.J., and the "JAWS OF LIFE®", which is manufactured and sold by Hurst Performance, Inc., of Warminster, Pa., are specialized tools used by rescue personnel to extricate accident victims from vehicles, buildings, and other structures which otherwise impose a difficult or nearly impossible means of egress. These tools typically develop spreading or ramming forces for opening or forcing apart inoperable doors, damaged structures, or blocked pathways.

However, the distance or range over which the spreading or cutting force can be applied is limited to the maximum spreading distance between the ends of the rescue tool. In situations where a larger opening is required, or where a suitable brace, prop, or support is available but located beyond the expandable reach of the rescue tool, the tool could be rendered virtually ineffective. Parts of an automobile, such as the door or steering wheel, may also be so badly damaged and contoured that the expandable range of the rescue tool is insufficient to extricate a victim.

To facilitate increasing the use of such rescue tools, rescue personnel may brace the hydraulic equipment against a brace, such as is described within U.S. Pat. No. 5,174,148. At least some known braces include a plurality of surface platforms extending from a body. The braces typically are positioned against a suitable support and the rescue tool is then braced against the brace during its operation. More specifically, at least some known braces include a plurality of angled platforms extending upwardly from a substantially planar lower surface. The surface platforms are angled to provide a structural support to which the rescue tool is braced.

However, because such braces are typically minimally adjustable, such braces are limited in their application, and are typically only used when space considerations permit their installation. Furthermore, such braces are typically fabricated from heavy-duty material to withstand the forces applied by the rescue tools, and as a result may be cumbersome and heavy to transport and handle. In addition, such braces are only effective when braced against a suitable structure, and as such the rescue tool may still be rendered virtually ineffective in situations when the distance between the portion of the structure to be forced open and the suitable support is too great, or in situations where the vehicle is badly damaged or contoured.

BRIEF SUMMARY OF THE INVENTION

In one aspect of the invention, a tool including an elongate body and a pair of opposing arms is provided. The arms include a first arm and a second arm that extend outwardly from the body. At least one of the first arm and the second arm are slidably coupled to the body. Each of the arms includes an inner face and an outer face, wherein at least one of the arm inner and outer faces includes a plurality of teeth.

In another aspect of the invention, a rescue tool is provided for use with emergency extrications from a vehicle. The tool includes a shaft and a pair of arms coupled to the shaft. The shaft has an axis of symmetry, and the pair of opposing arms include a first arm and a second arm. At least one of the first arm and the second arm is slidably coupled to the shaft and is configured to move along the shaft in a direction that is substantially parallel to the shaft axis of symmetry. Each of the arms includes an inner face and an outer face. At least one of the arm inner and outer faces includes a plurality of teeth configured to contact the vehicle. At least one of the first arm and the second arm extends substantially perpendicularly to the shaft.

In a further aspect, a rescue extrication system is provided. The system includes a hydraulic ram having a first end and a second end, and a rescue tool configured to coupled to a vehicle during an extrication to provide structural support for the hydraulic ram. The rescue tool includes a body and a pair of opposing arms. At least one of the pair of opposing arms is slidably coupled to the body. Each arm includes an inner face and an outer face, and at least one of the arm inner face and outer faces includes a plurality of teeth extending substantially along a length of the face.

In yet another aspect of the invention, a method of emergency extrication from a vehicle with a rescue tool is provided. The method includes providing a rescue tool including a body and a pair of arms coupled to the body and extending outwardly from the body, wherein each at least one arm includes an inner face including a plurality of teeth, and an outer face including a plurality of teeth, adjusting at least one of the pair of arms plurality of teeth contacts the vehicle, and performing the extrication from the vehicle.

DETAILED DESCRIPTION OF THE INVENTION

Figure 1:
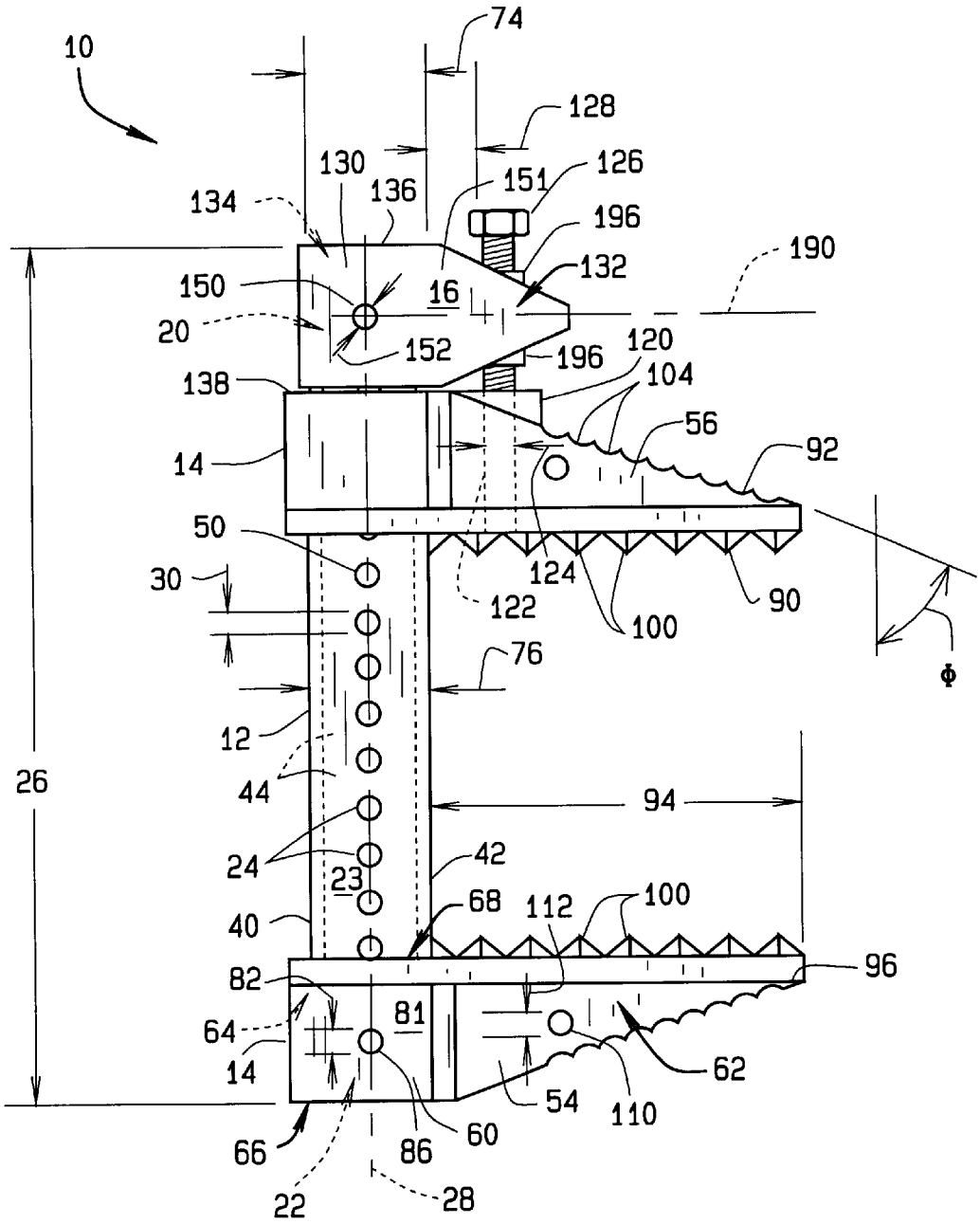
FIG. 1 is a side view of rescue tool.

FIG. 1 is a side view of rescue tool 10 that may be used to perform emergency extrications from a structure, including but not limited to vehicles, buildings, and other structures which otherwise impose a difficult or nearly impossible means of egress. Tool 10 includes a body 12, a pair of arms 14, and a coupling 16. Body 12 is hollow and includes a first end 20, a second end 22, an outer surface 23, an inner surface (not shown) and a plurality of openings 24 extending between outer surface 23 and the body inner surface. Accordingly, body 12 has a length 26 measured between ends 20 and 22. In the exemplary embodiment, body length 26 is approximately 18.25 inches. Body 12 also has a centerline 28 extending between ends 20 and 22. In a further embodiment, body 12 is formed of a plurality of members telescopically coupled, and as such, body length 26 is variably adjustable.

Openings 24 are identical and are spaced evenly along body 12 between first and second ends 20 and 22, respectively. In the exemplary embodiment, adjacent openings are spaced approximately 1.0 inches apart. In an alternative embodiment, openings 24 are not spaced evenly along body 12. In a further embodiment, openings 24 are non-identical. Each opening 24 has a diameter 30 sized to receive a locking pin (not shown in FIG. 1) therethrough.

In the exemplary embodiment, body 12 has a substantially square cross-sectional profile. In an alternative embodiment, body 12 has a substantially non-square cross-sectional profile. Accordingly, body 12 includes an outer wall 40, a substantially parallel and opposite inner wall 42, and a pair of identical sidewalls 44. In the exemplary embodiment, walls 40 and 42 are identical with sidewalls 44, and extend substantially perpendicularly from sidewalls 44. Alternatively, walls 40 and 42 are identical with each other, but are not identical with sidewalls 44.

Walls 40 and 42, and sidewalls 44 are coupled together to define a cavity 50 within body 12. In the exemplary embodiment, body 12 is formed integrally and unitarily to include walls 40 and 42, and sidewalls 44. Openings 24 extend through sidewalls 44 between body outer surface 23 and the body inner surface. In one embodiment, walls 40 and 42 also include openings 24. In the exemplary embodiment, walls 40 and 42, and sidewalls 44 are substantially planar.

Arms 14 are coupled to body 12 and include a first arm 54 and a second arm 56 that extend substantially perpendicularly from body 12. Arms 14 are substantially similar and each includes a base portion 60 and a gripping portion 62 extending from base portion 60. In an alternative embodiment, arms 14 are identical. In the exemplary embodiment, arms 14 are integral and are formed unitarily with base portion 60 and gripping portion 62. Arm base portion 60 is hollow and includes a bore 64 extending between an outer side 66 of arm 14 to an inner side 68 of arm 14 and defined by an inner surface of base portion 60. In the exemplary embodiment, bore 64 has a substantially square cross-sectional profile.

Base portion bore 64 is sized to enable each arm 14 to be slidably coupled to body 12. More specifically, each bore cross-sectional profile is sized slightly larger than a cross-sectional profile of body 12 defined by body outer surface 23. For example, base portion bore 64 has a width 74 measured with respect to the base portion inner surface that is slightly wider than a corresponding width 76 of body 12. Accordingly, each bore cross-sectional profile shape is identical with the body cross-sectional profile shape.

In the exemplary embodiment, each base portion 64 is substantially cube-shaped and includes at least one opening 80 extending between an outer surface 81 of arm 14 to the base portion inner surface. In an alternative embodiment, only first arm 54 includes opening 80. More specifically, opening 80 is positioned with respect to base portion 64 such that as arm 14 is slidably coupled to body 12, opening 80 may be concentrically aligned with respect to a respective body opening 24. Opening 80 has a diameter 82 that is approximately equal body opening diameter 30, and accordingly opening 80 is sized to receive a locking pin therethrough for coupling each arm 14 to body 12. In the exemplary embodiment, opening diameter 82 is approximately equal 0.5 inches.

Each arm gripping portion 62 includes an inner face 90 and an oppositely disposed outer face 92. Inner face 90 is substantially perpendicular to body 12 and extends outward from body 12 a length 94 to an outer tip 96 of gripping portion 62. Inner face 90 includes a plurality of teeth 100 extending over a width (not shown in FIG. 1) of inner face 90 and along inner face length 94. Inner face length 94 is variably selected to provide enough surface area to enable teeth 100 to provide stability to tool 10 when coupled to a structure (not shown in FIG. 1). In one embodiment, teeth 100 are machined into inner face 90. In an alternative embodiment, teeth 100 are coupled with fasteners (not shown) to inner face 90, and as such are replaceable. In the exemplary embodiment, teeth 100 extend outwardly from inner face 90 and are substantially pyramidal. In an alternative embodiment, teeth 100 are substantially non-pyramidal.

In the exemplary embodiment, each gripping portion 62 is substantially pyramidal-shaped, and outer face 92 is positioned at an angle Ø with respect to body centerline 28. More specifically, in the exemplary embodiment, outer face angle Ø is approximately equal 75°. Accordingly, outer face 92 extends obliquely from arm base portion 64 to gripping portion tip 96. In the exemplary embodiment, outer face 92 has a substantially triangular cross-sectional profile. In one embodiment, gripping portion 62 is removably coupled to base portion 64. Outer surface 92 includes a plurality of teeth 104 extending over gripping portion 62.

Gripping portion 62 also includes an opening 110 extending through gripping portion 62. Opening 110 has a diameter 112 that is sized to receive a clevis pin (not shown in FIG. 1) therethrough.

In the exemplary embodiment, first arm 54 and second arm 56 are slightly different. In an alternative embodiment, arms 54 and 56 are identical. Accordingly, in the exemplary embodiment, arm 56 includes an attachment 120 having a bore 122 extending therethrough and at least partially into arm gripping portion 62. Bore 122 has a diameter 124 that is sized to receive a coupling fastener 126 therethrough. In one embodiment, attachment 120 is formed integrally with gripping portion 62, and is positioned such that bore 122 is a distance 128 from body 12.

Coupling 16 includes a base portion 130 and an adjustment portion 132. Coupling base portion 130 is hollow and includes a bore 134 extending between an outer side 136 of coupling 16 to an inner side 138 of coupling 16, and defined by an inner surface (not shown) of base portion 130. In the exemplary embodiment, bore 134 has a substantially square cross-sectional profile.

Coupling base portion bore 134 is sized to enable coupling 16 to be slidably coupled to body 12. More specifically, the coupling bore cross-sectional profile is sized slightly larger than a cross-sectional profile of body 12 defined by body outer surface 23. For example, coupling base portion bore 134 has a width (not shown) measured with respect to the coupling base portion inner surface that is slightly wider than body width 76. Accordingly, the coupling bore cross-sectional profile shape is identical with the body cross-sectional profile shape.

In the exemplary embodiment, coupling base portion 134 is substantially cube-shaped and includes at least one opening 150 extending between an outer surface 151 of coupling 16 to the coupling base portion inner surface. More specifically, coupling opening 150 is positioned with respect to coupling base portion 134 such that as coupling 16 is slidably coupled to body 12, opening 150 may be concentrically aligned with respect to a respective body opening 24. Opening 150 has a diameter 152 that is approximately equal body opening diameter 30, and accordingly opening 150 is sized to receive a locking pin therethrough for coupling each coupling 16 to body 12, such that coupling 16 is maintained in a relative position with respect to body 12. In the exemplary embodiment, opening diameter 152 is approximately equal 0.5 inches.

Coupling adjustment portion 132 extends from base portion 130. In the exemplary embodiment, coupling adjustment portion 132 is symmetrical about a centerline axis 190 extending from base portion 130 through adjustment portion 132. Adjustment portion 132 includes an opening (not shown) extending therethrough and having a diameter 194. Diameter 194 is sized to receive coupling fastener 126 therethrough. The coupling opening is positioned such that when coupling 16 is attached to body 12, the coupling opening is aligned substantially concentrically with respect to arm gripping portion attachment bore 122. In the exemplary embodiment, coupling fastener 126 is threadingly coupled to the coupling opening and/or arm attachment bore 122. More specifically, coupling fastener 126 extends through a pair of nuts 196 threadingly coupled to fastener 126 on each side 136 and 138 of coupling adjustment portion 132 such that rotation of fastener 126 causes a corresponding axial movement of arm 56 either towards arm 54, or from arm 54, depending upon a rotational direction of fastener 126. In an alternative embodiment, tool 10 includes a pair of couplings 16 such that axial movement of each arm 14 is controlled by fasteners 126.

Coupling fastener 126 couples coupling 16 to arm 56 and controls movement of arm 56. Furthermore, coupling 16 controls an amount of pressure exerted by arms 14 on a structure held between arm inner faces 90. In addition, when tool 10 is secured to a structure such that the structure is between arm inner faces 90, coupling fastener 126 maintains arm 56 in a relative position with respect to arm 54 such that a relative position of tool 10 is maintained with respect to the structure. In one embodiment, a tee handle (not shown in FIG. 1) is utilized to manually rotate coupling fastener 126.

During operation, arms 14 are moveable axially along body length 26 in a direction that is substantially parallel to body centerline 28, and such that arm inner faces 90 remain substantially parallel. In the exemplary embodiment, finite movement of at least one arm 14 is controlled through coupling fastener 126. In an alternative embodiment, tool 10 includes two couplings 16 which control movement of both arms 14. In an alternative embodiment, hydraulic pressure is applied through coupling 16 to control movement of at least one arm 14. Alternatively, any source of power capable of moving arm 14 in the method described herein may be utilized, including but not limited to, pneumatic, electrical, or electromagnetic sources of power. In another embodiment, tool 10 includes a coupling (not shown) which enables a drill (not shown) to be rotatably coupled to tool 10 for controlling movement of at least one arm 14.

Figure 2:
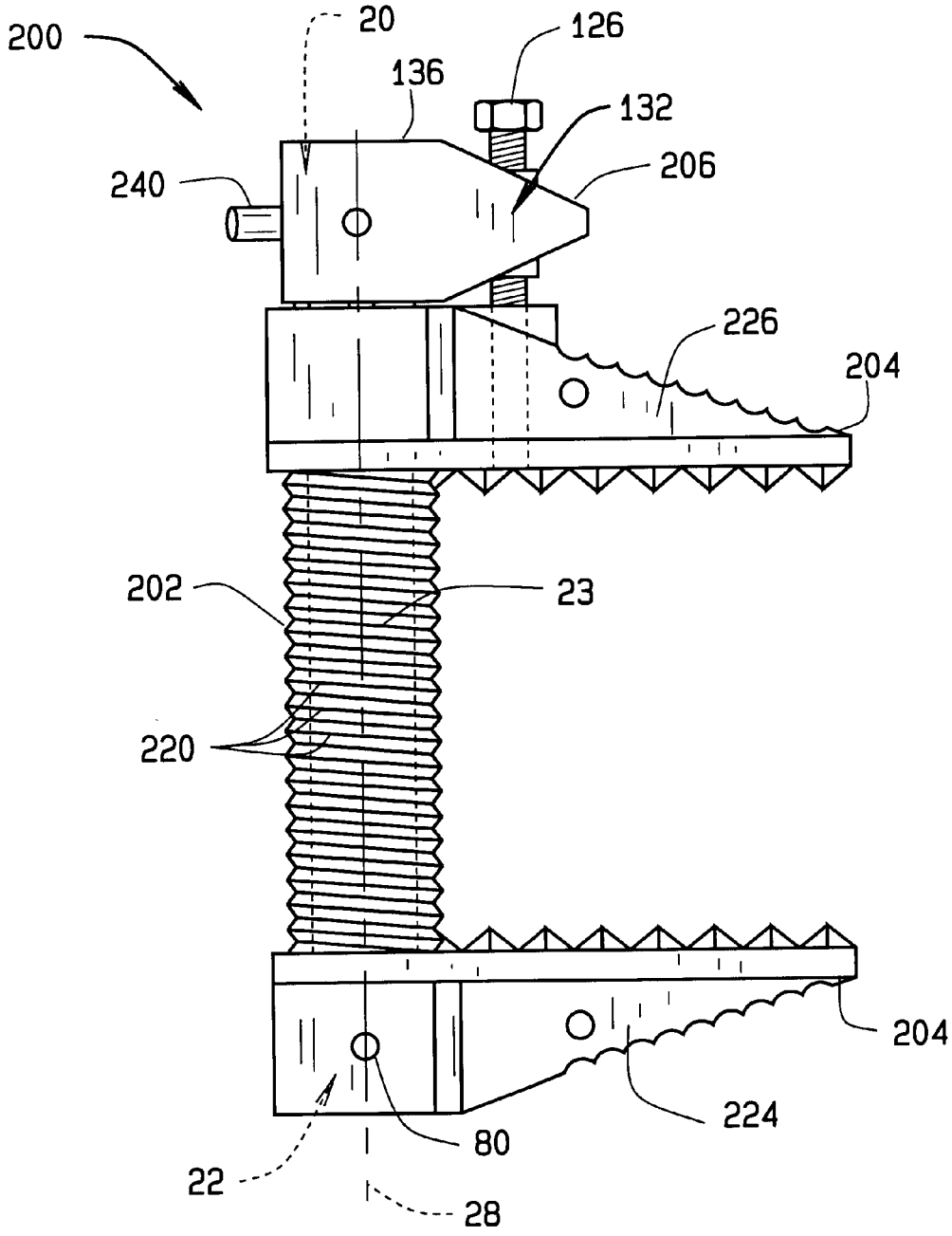
FIG. 2 is an alternative embodiment of a rescue tool.

FIG. 2 is an alternative embodiment of a rescue tool 200 user for emergency extrications from a structure, including but not limited to vehicles, buildings, and other structures which otherwise impose a difficult or nearly impossible means of egress. Rescue tool 200 is substantially similar to tool 10 shown in FIG. 1, and components of tool 200 that are identical to components of tool 10 are identified in FIG. 2 using the same reference numerals used in FIG. 1. Accordingly, tool 200 includes a body 202, a pair of arms 204, and a coupling 206. Body 202 includes first end 20, second end 22, and outer surface 23. Body 202 also has centerline 28 extending between ends 20 and 22. In an alternative embodiment, body 202 does not include any openings 24.

In the exemplary embodiment, body 12 has a substantially circular cross-sectional profile. In an alternative embodiment, body 12 has a substantially non-circular cross-sectional profile. Body 12 also includes a plurality of threads 220 extending between ends 20 and 22.

Arms 204 are substantially similar to arms 14 (shown in FIG. 1). However, arms 204 are not slidably coupled to body 202, but rather, arms 204 are threadingly coupled to body 202. Arms 204 include a first arm 224 and a second arm 226, and at least one of the arms 224 and 226 includes opening 80 for receiving a locking pin (not shown in FIG. 2) therethrough for maintaining a relative position of that arm 204 with respect to body 202. In an alternative embodiment, at least one of arms 224 and 226 is maintained in a relative position with respect to body 202 using an alternative means including, but not limited to, lock nuts (not shown), clamps (not shown), cam-locks, or quick-release clips (not shown).

In the exemplary embodiment, first arm 224 and second arm 226 are slightly different. In an alternative embodiment, arms 224 and 226 are identical. Accordingly, in the exemplary embodiment, arm 226 includes attachment 120.

Coupling 206 is substantially similar to coupling 16 (shown in FIG. 1). However, coupling 206 is not slidably coupled to body 202, but rather, coupling 206 is threadingly coupled to body 202. In an alternative embodiment, coupling 206 does not include opening 150 and rather an alternate means are utilized to maintain coupling 202 in a relative position with respect to body 202, including, but not limited to lock nuts, clamps, cam-locks, or quick-release clips.

Coupling 206 includes coupling adjustment portion 132 and base portion 130. Coupling fastener 126 couples coupling 206 to at least one arm 204 such that rotation of fastener 126 causes a corresponding axial movement of arm 226 either towards arm 224, or from arm 224, depending on a rotational direction of fastener 126. In an alternative embodiment, tool 200 includes a pair of couplings 206 such that axial movement of each arm 204 is controlled by fasteners 126. In the exemplary embodiment, tool 200 includes a hydraulic fitting 240 that enables rotation of fastener 126 and movement of fastener 126 is controlled using a source of hydraulic pressure. Alternatively, any source of power may be utilized to move arm 226 including, but not limited to, pneumatic, electrical, or electromagnetic sources of power. In another embodiment, tool 10 includes a coupling (not shown) which enables a drill to be rotatably coupled to tool 10 for controlling movement of at least one arm 14.

Figure 3:
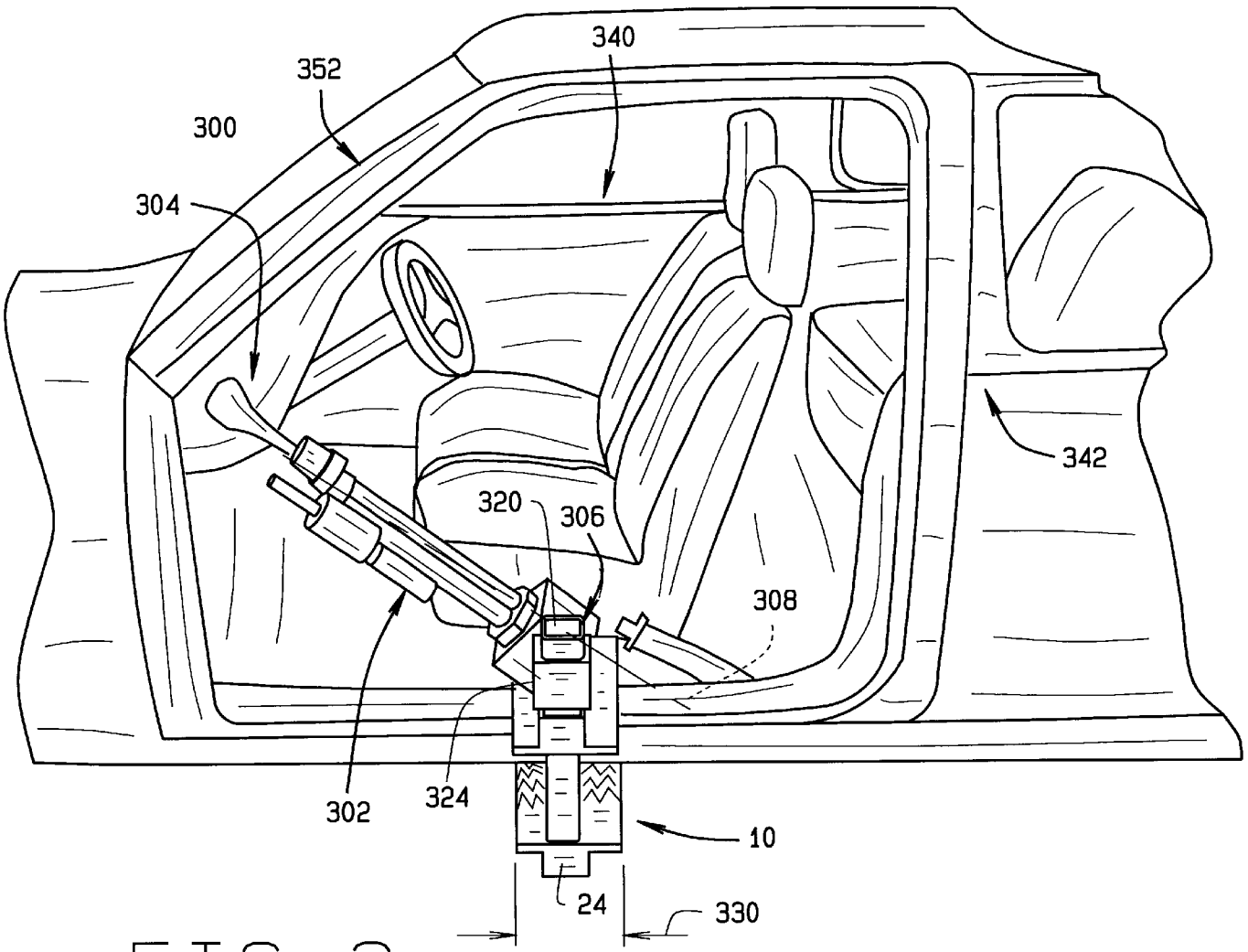
FIG. 3 is a side view of an exemplary embodiment of an emergency extrication from a vehicle using the rescue tool shown in FIG. 1 and a known ram device.

FIG. 3 is a side view of an exemplary embodiment of an emergency extrication from a vehicle 300 using rescue tool 10, and a known ram device 302. Alternatively, rescue tool 10 may be used in performing extrications from non-vehicles including, but not limited to buildings, construction equipment, boats, aircraft, or military applications. Ram device 302 is hydraulically expandable and includes a first end 304, a second end 306, and a centerline axis 308 extending therebetween. Ends 304 and 306 are known as spreadable tip ends of ram device 302 and transmit an output force during operation of ram device 302. More specifically, ram device 302 is telescopically assembled and when structurally braced at one end, is expandable longitudinally in a direction substantially parallel a centerline axis 310 of ram device 302. In one embodiment, ram device 302 is expandable through both ends 304 and 306. In another embodiment, ram device 302 is expandable through only one end 304 or 306.

Ram devices 302 are known and may be extrication device that is longitudinally expandable from at least one end while braced, as described herein, at one end. In one embodiment, ram device 302 is similar to the device described in U.S. Pat. No. 5,810,333. In another embodiment, ram device 302 is similar to the device described in U.S. Pat. No. 4,783,053.

Tool body 12 is hollow and includes outer surface 23 and an inner surface 320. In the exemplary embodiment, tool arm 54 and coupling 16 are each coupled to body 12 with a locking pin 324. Furthermore, each arm gripping portion 62 includes plurality of teeth 100 extending over a width 330 of inner face 90. Inner face width 330 is variably selected to provide enough surface area to enable teeth 100 to provide stability to tool 10 when coupled to vehicle 300.

During a vehicle extrication, rescue tool 10 is utilized to facilitate removing a victim or victims from a damaged vehicle, such as vehicle 300, in an efficient and orderly manner. Specifically, as illustrated in FIG. 3, tool 10 facilitates extrications from vehicle 300 using a door removal extrication process. The door removal extrication process is utilized when a vehicle door 340 is stuck or jarred and compromises access to a victim. In such a process, initially a door 340 is removed from vehicle 300 using a known tool, such as an air chisel or a cutter.

In addition to a door 340 being damaged, a vehicle side brace 342 adjacent the door 340 may also be so badly contoured or damaged that it may not be used as a support brace for ram device 302. Furthermore, depending on a make and model of vehicle 300, as well as inherent expandability limitations of ram device 302, a structural brace may not be available to enable the use of ram device 302. Because rescue tool 10 may be variably positioned with respect to vehicle 300, rescue tool 10 enables ram device 302, to be utilized, despite damage to vehicle side brace 342 or despite expandability limitations of ram device 302.

During use, rescue tool 10 is coupled to vehicle 300 such that a portion 344 of vehicle 300 is held between tool arms 14. More specifically, initially ram device 302 is positioned against the portion of vehicle 300 that is desired to be forcibly moved. In the exemplary embodiment, ram device 302 is positioned such that ram device first end 304 is in contact with and against a structural frame 352 of vehicle 300. Rescue tool 10 is positioned adjacent vehicle 300 at a location that permits tool 10 to be used as a structural brace for ram device 302. Furthermore, because rescue tool 10 is variably positioned with respect to vehicle 300, tool 10 enables ram device 302 to be braced against tool 10 such that the maximum inherent expandability limits or the maximum spreading distance between ram ends 304 and 306 is not exceeded during operation of ram device 302.

Rescue tool 10 is then coupled securely to vehicle 300. More specifically, in the exemplary embodiment, arm 56 is moved towards arm 54 by coupling 16, such that vehicle portion 344 is contacted by rescue tool gripping portion teeth 100 and held tightly between both arm gripping portions 62. Ram device 302 is then braced securely against tool arm outer face 92, and between tool 10 and vehicle frame 352. As power is applied to ram device 302, ram device 302 is longitudinally expanded, thus forcibly widening the access into vehicle 300. Furthermore, as power is applied to ram device 302, gripping portion teeth 104 facilitate preventing ram device 302 from slipping during expanding operation.

Because of size and weight considerations, one user may coupled rescue tool 10 to vehicle 300. Furthermore, once teeth 100 have contacted vehicle 300, and arms 14 have been tightened and secured in position, tool 10 remains statically secured to vehicle 300 during the extrication process, and thus facilitates extending the useful applications of ram devices 302.

Figure 4:
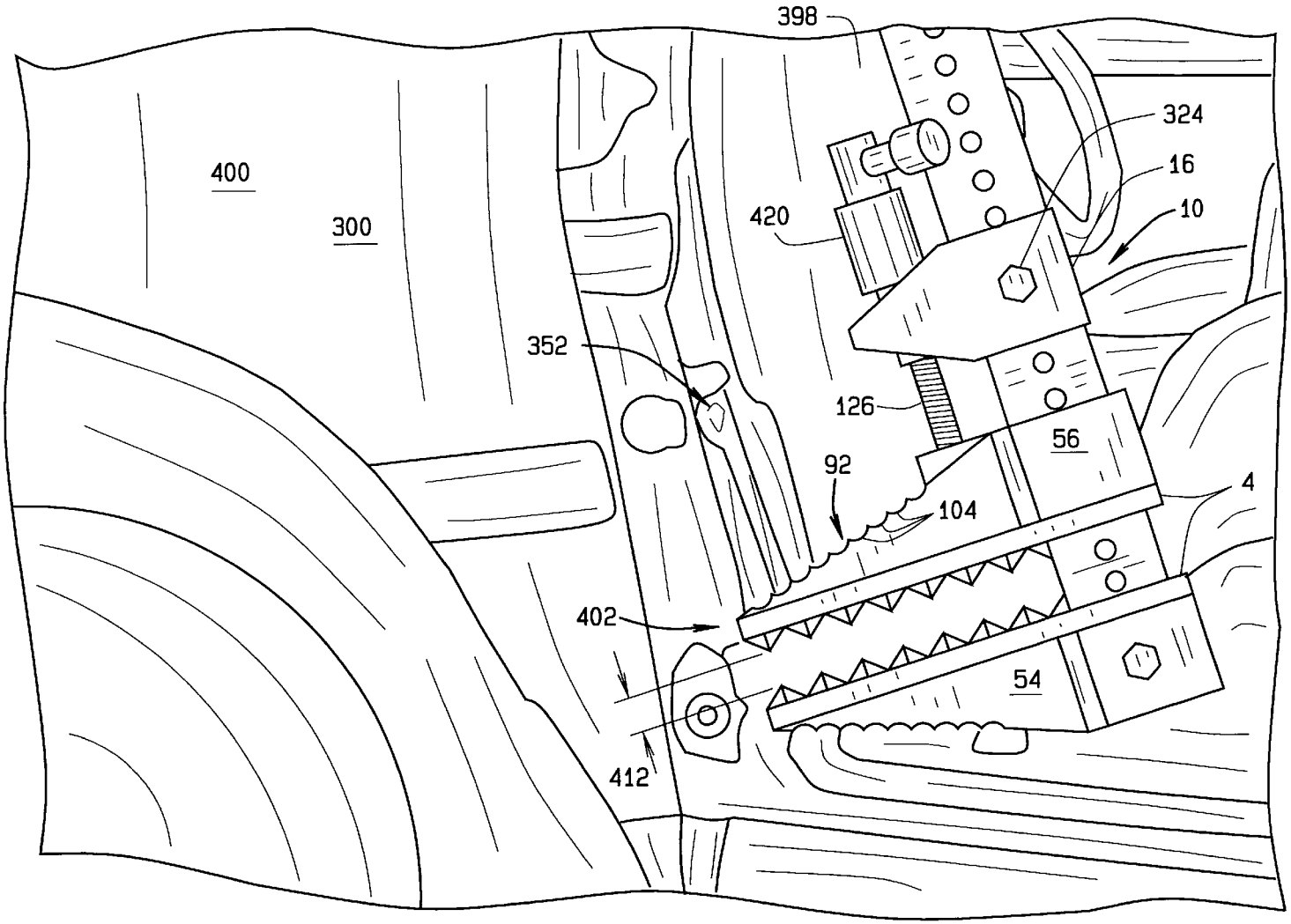
FIG. 4 is a side view of an exemplary embodiment of an alternative emergency extrication from a vehicle using the rescue tool shown in FIG. 1.

FIG. 4 is a side view of an exemplary embodiment of an alternative emergency extrication from vehicle 300 using rescue tool 10. During a vehicle extrication, rescue tool 10 is utilized to facilitate removing a victim or victims from a damaged vehicle, such as vehicle 300, in an efficient and orderly manner. Specifically, as illustrated in FIG. 4, tool 10 facilitates extrications from vehicle 300 using a dash roll and support extrication process. The dash roll and support extrication process is utilized when a vehicle dashboard 398 or a vehicle front end 400 has shifted aftward against the victim, and have pinned the victim within the vehicle 300. In such a process, a door 340 (shown in FIG. 3) is initially removed from vehicle 300 using a known tool, such as an air chisel or a cutter.

A relief cut 402 is then made within vehicle frame 352. Rescue tool 10 is then inserted within relief cut 402 and used to forcibly shift the dash and/or vehicle front end 400 forward and upwardly away from the victim. In an alternative embodiment, tool 10 is not used to forcibly shift the dash and/or vehicle front end 400 upwardly, but rather, tool 10 is inserted within cut 402 to maintain a relative position of a rolled dash. More specifically, in the exemplary embodiment, tool 10 is initially adjusted such that arm 56 is in close proximity to arm 54. Coupling 16 is then securely fastened to body 12 with locking pin 324 or some other suitable fastener. Tool arms 14 are then inserted into relief cut 402 such that each arm outer surface 92 is in contact with structural frame 352. More specifically, when tool 10 is inserted within relief cut 402, rescue tool gripping portion outer surface teeth 104 contact vehicle 300.

A distance 412 between rescue tool arms 14 is increased. More specifically, coupling fastener 126 is rotated to move arm 56 in a direction away from arm 54. In the exemplary embodiment, coupling fastener 126 is manually rotated with a T-handle 420. As arms 56 and 54 are separated, the vehicle dashboard and/or vehicle front end 400 is forcibly shifted upwardly and forwardly. Furthermore, as arms 14 are separated, gripper portion teeth 104 couple against vehicle 300 to facilitate stabilizing and securing rescue tool 10 to vehicle 300. As the victim is extricated from vehicle 300, rescue tool 10 is maintained in position within relief cut 402 to facilitate preventing vehicle front end 400 and/or the vehicle dashboard from "rolling back" or shifting undesirably towards the victim.

Figure 5:
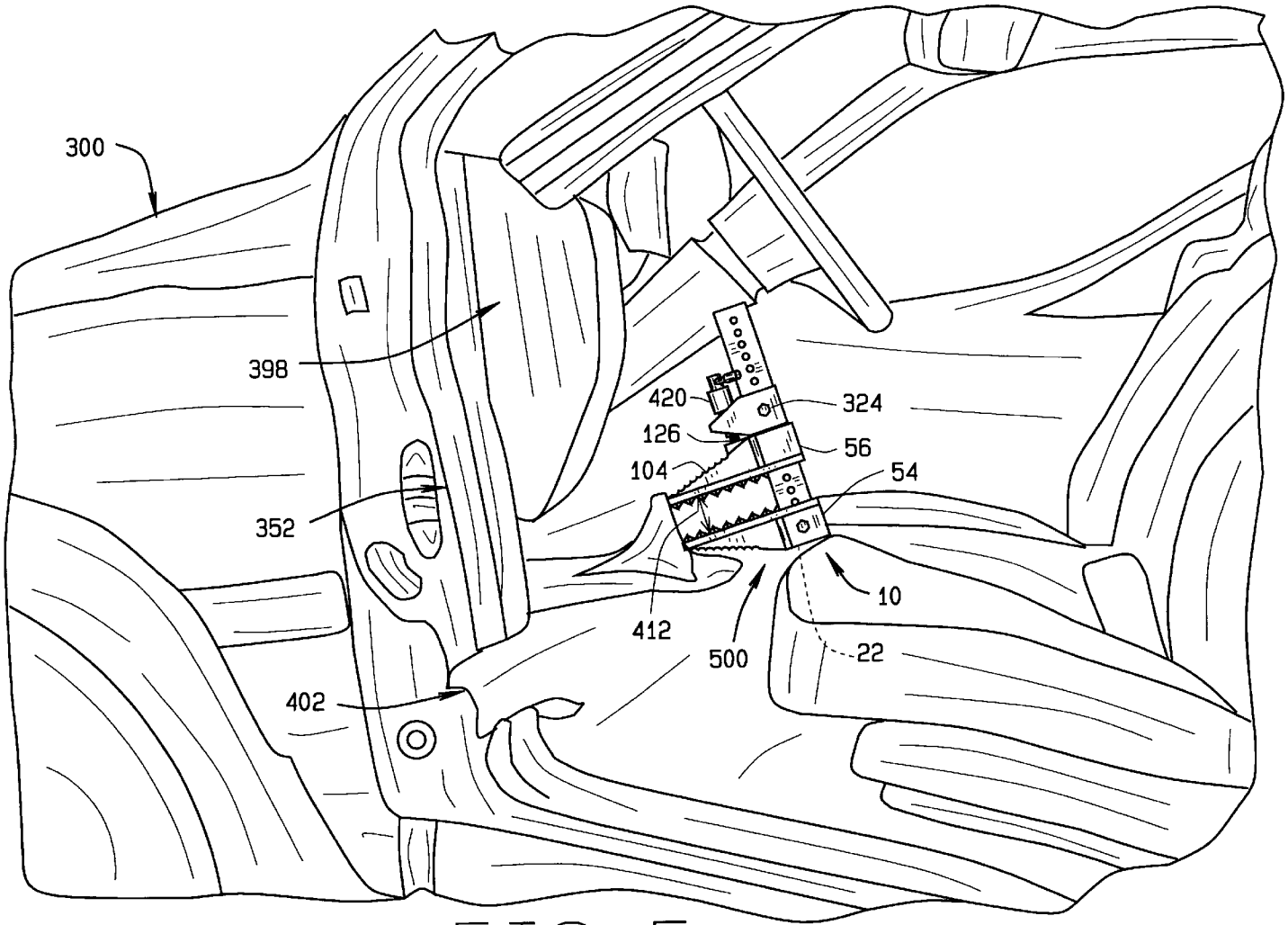
FIG. 5 is a side view of an exemplary embodiment of another alternative emergency extrication from a vehicle using the rescue tool shown in FIG. 1.

FIG. 5 is a side view of an exemplary embodiment of another alternative emergency extrication from vehicle 300 using rescue tool 10. During a vehicle extrication, rescue tool 10 is utilized to facilitate removing a victim or victims from a damaged vehicle, such as vehicle 300, in an efficient and orderly manner. Specifically, as illustrated in FIG. 5, tool 10 facilitates extrications from vehicle 300 using a modified dash roll and support extrication process that is similar to the dash roll and support extrication process illustrated in FIG. 4. The modified dash roll and support extrication process is utilized when a vehicle dashboard 398 or a vehicle front end 400 has shifted aftward against the victim, and have pinned the victim within the vehicle 300. In such a process, a door 340 (shown in FIG. 3) is initially removed from vehicle 300 using a known tool, such as an air chisel or a cutter.

Relief cut 402 is then made within vehicle frame 352. Rescue tool 10 is then positioned between dashboard 398 and a floorboard 500 of vehicle 300. More specifically, in the exemplary embodiment, tool 10 is initially adjusted such that arm 56 is in close proximity to arm 54. Coupling 16 is then securely fastened to body 12 with locking pin 324 or some other suitable fastener. Tool 10 is then positioned between dashboard 398 and floorboard 500 such that rescue tool gripping portion outer surface teeth 104 contact dashboard 398 and tool 10 is braced against floorboard 500. In the exemplary embodiment, tool body end 22 is braced against floorboard 500 and gripping portion teeth 104 of arm 56 are against dashboard 398. In an alternative embodiment, depending upon the relative position of dashboard 398 with respect to floorboard 500, tool 10 may be utilized such that arm 54 is braced and contacts floorboard 500 rather than tool body end 22. In a further alternative embodiment, tool 10 is not utilized to roll dashboard 398, but rather is used to maintain dashboard 398 in a rolled position, such that a ram device, such as device 302 (shown in FIG. 3) may be removed from vehicle 300.

Rescue tool arm separation distance 412 is increased. More specifically, coupling fastener 126 is rotated to move arm 56 in a direction away from arm 54. In the exemplary embodiment, coupling fastener 126 is manually rotated with T-handle 420. As arms 56 and 54 are separated, vehicle dashboard 398 and/or vehicle front end 400 are forcibly shifted upwardly and forwardly. Furthermore, as arms 14 are separated, gripper portion teeth 104 couple against dashboard 398 to facilitate stabilizing and securing rescue tool 10 to vehicle 300. As the victim is extricated from vehicle 300, rescue tool 10 is maintained in position to facilitate preventing vehicle front end 400 and/or the vehicle dashboard from "rolling back" or shifting undesirably towards the victim.

Figure 6:
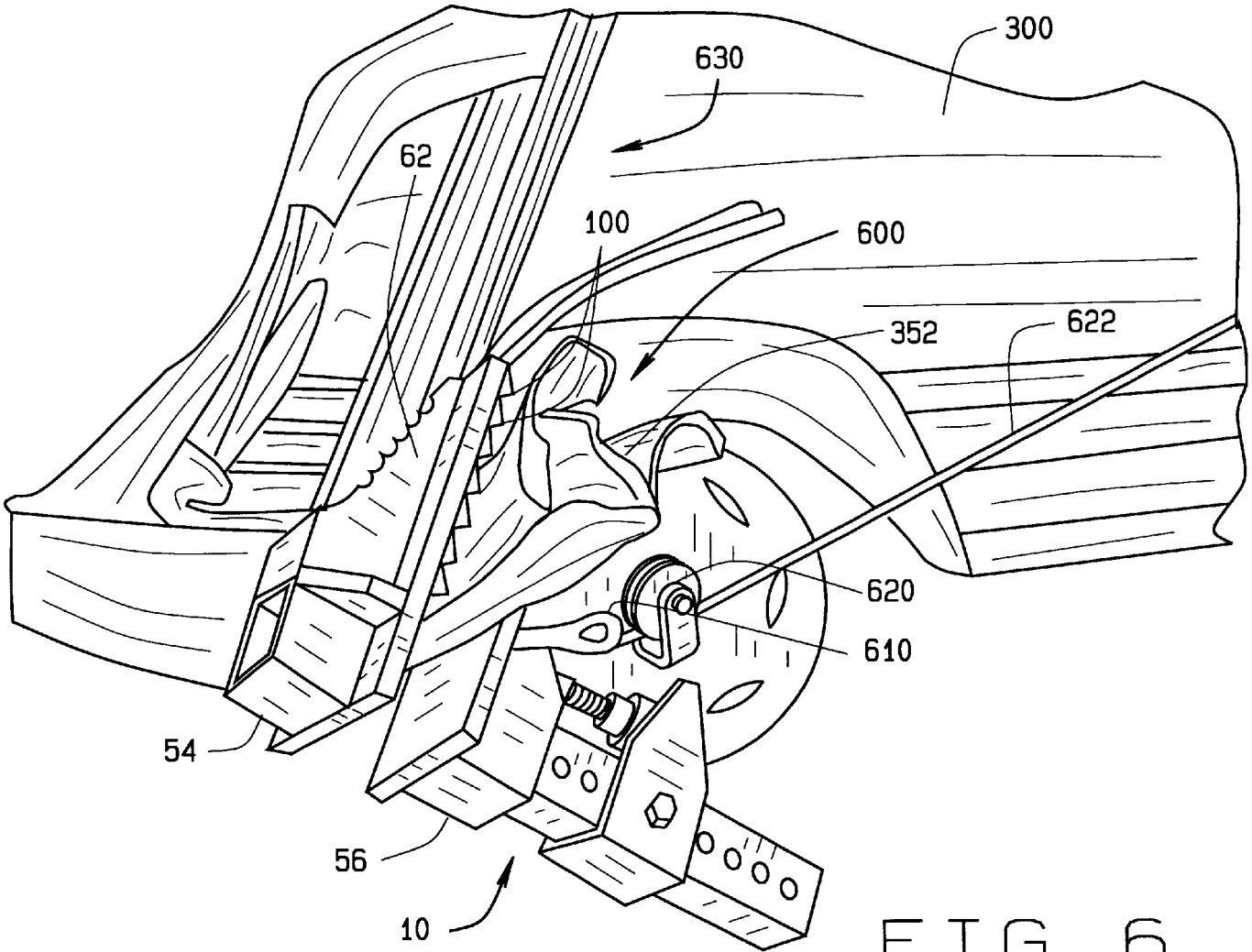
FIG. 6 is a side view of an exemplary embodiment of a further alternative emergency extrication from a vehicle using the rescue tool shown in FIG. 1.

FIG. 6 is a side view of an exemplary embodiment of another alternative emergency extrication from vehicle 300 using rescue tool 10. During a vehicle extrication, rescue tool 10 is utilized to facilitate removing a victim or victims from a damaged vehicle, such as vehicle 300, in an efficient and orderly manner. Specifically, as illustrated in FIG. 6, tool 10 facilitates extrications from vehicle 300 using a third door conversion extrication process. The third door conversion extrication process is utilized to gain access to rear-seated victims in two-door vehicles 300, or rear-seated victims in vans (not shown). Furthermore, the third door conversion extrication process is also utilized when a vehicle dashboard 398 (shown in FIGS. 3–5) or a vehicle front end 400 (shown in FIGS. 3–5) is so badly damaged, or has shifted beyond to a point that may limit the use of the other aforementioned extrication processes. In such an extrication process, a door 340 (shown in FIG. 3) is initially removed from vehicle 300 using a known tool, such as an air chisel or a cutter.

Rescue tool 10 is then coupled to vehicle 300 such that a portion 600 of vehicle 300 is held between tool arms 14. More specifically, in the exemplary embodiment, rescue tool 10 is coupled a structural door frame 352 of vehicle 300. In one embodiment, at least one relief cut 402 (shown in FIGS. 4 and 5) is made into door frame 352. As described above, arm 56 is moved towards arm 54 by coupling 16, such that vehicle frame 352 is contacted by rescue tool gripping portion teeth 100 and held tightly between both arm gripping portions 62.

A clevis 610 may be then be coupled to rescue tool 10 using for example, gripping portion opening 110 (shown in FIG. 1). In the exemplary embodiment, a pulley 620 is attached to clevis 610, and a cable 622 extending from a powered winch (not shown) is coupled to tool 10 and through pulley 620. As the winch is operated, rescue tool 10 remains statically secured to vehicle 300, and a portion 630 of vehicle 300 is "rolled back" or shifted such that access to a vehicle rear seat 640 is widened.

Exemplary embodiments of rescue tools and extrication processes are described above in detail. The tools and extrication processes are not limited to the specific embodiments described herein, but rather, components of each rescue system and tool may be utilized independently and separately from other components described herein. Each rescue tool can also be used in combination with other extrication processes.

The above-described rescue tool includes a pair of arms extending from and slidably coupled to a body. At least one of the arms is coupled to the tool body with an adjustable coupling. Each arm includes an inner gripping portion that includes a plurality of teeth, and an outer face that also includes a plurality of teeth. The tool does not need to be structurally braced, but rather is adjustable and variably positioned to provide a structural brace to a ram device. Furthermore, the tool is not limited in its use to that of only providing a structural brace for a ram device, but rather the tool is multi-functional and may be utilized in a variety of extrication purposes. Additionally, the tool may also be utilized in a variety of non-extrication purposes. As a result, a rescue tool is provided that facilitates performing extrications of victims in a cost-effective and reliable manner.

While the invention has been described in terms of various specific embodiments, those skilled in the art will recognize that the invention can be practiced with modification within the spirit and scope of the claims.

What is claimed is:

1. A tool comprising:

an elongate body; and a pair of opposing arms comprising a first arm and a second arm extending outwardly from said body, at least one of said first arm and said second arm slidably coupled to said body, each said arm comprising an inner face and an outer face, said first arm inner and outer face comprising a plurality of teeth, wherein said plurality of teeth extending along said first arm inner face extend substantially from a radially outer tip of said face to said body, said at least one of said second arm inner and outer face comprises a plurality of teeth.

2. A tool in accordance with claim 1 wherein said first arm substantially parallel and facing said second arm.

3. A tool in accordance with claim 1 wherein said first arm inner face is between said first arm outer face and said second arm, said first and second arm inner faces each comprise a plurality of teeth.

4. A tool in accordance with claim 1 wherein each said second arm inner and outer faces each comprise a plurality of teeth.

5. A tool in accordance with claim 1 wherein each said arm is slidably coupled to said body.

6. A tool in accordance with claim 5 wherein said body comprises an axis of symmetry, each said arm is slidable along said body in a direction substantially parallel to said body axis of symmetry.

7. A tool in accordance with claim 1 wherein said first arm is substantially parallel to said second arm, said first and second arms slidable along said body such that said first arm remains substantially parallel to said second arm.

8. A tool in accordance with claim 1 wherein said body is hollow and has a cross-sectional profile defined by an outer surface.

9. A tool in accordance with claim 8 wherein each said arm comprises a bore extending therethrough and sized to receive said body therethrough.

10. A tool in accordance with claim 1 further comprising a collar configured to couple with said body.

11. A tool in accordance with claim 10 wherein said collar is further configured to couple with at least one of said first arm and said second arm.

12. A tool in accordance with claim 10 wherein said collar is further configured to threadingly couple with at least one of said first arm and said second arm.

13. A tool in accordance with claim 10 wherein said collar is further configured to limit an amount of travel of at least one of said first arm and said second arm.

14. A tool in accordance with claim 1 wherein said first and second arms each comprise a coupling portion and a gripping portion, each said coupling portion is configured to couple each said arm with said body, each said gripping portion extending from said coupling portion.

15. A tool in accordance with claim 14 wherein at least one of said first arm gripping portion and said second arm gripping portion has a substantially triangular cross-sectional profile.

16. A tool in accordance with claim 14 wherein said each said arm gripping portion has a substantially triangular cross-sectional profile.

17. A tool in accordance with claim 1 wherein said body comprises a plurality of openings for coupling at least one of said arms to said body.

18. A rescue tool for use with emergency extrications from a structure, said tool comprising:

a shaft comprising a centerline axis; and a pair of opposing arms coupled to said shaft and comprising a first arm and a second arm, at least one of said first arm and said second arm slidably coupled to said shaft and configured to move along said shaft in a direction substantially parallel to said shaft centerline axis, each said arm comprising an inner face and an outer face, said first arm inner and outer face each comprise a plurality of teeth configured to contact the structure, wherein said plurality of teeth extending along said first arm inner face extend substantially from a radially outer tip of said inner face to said body, at least one of said second arm inner and outer face comprises a plurality of teeth, at least one of said first arm and said second arm extending substantially perpendicularly to said shaft.

19. A rescue tool in accordance with claim 18 wherein each said second arm inner face and said arm outer face comprises a plurality of teeth configured to engage the structure.

20. A rescue tool in accordance with claim 19 wherein said first arm is substantially parallel to said second arm.

21. A rescue tool in accordance with claim 19 wherein each said arm is slidably coupled to said shaft and moveable in a direction substantially parallel to said shaft centerline axis.

22. A rescue tool in accordance with claim 19 wherein each said arm is slidably coupled to said shaft and slidable such that said first arm remains substantially parallel to said second arm.

23. A rescue tool in accordance with claim 19 wherein said shaft is hollow.

24. A rescue tool in accordance with claim 19 wherein each said arm comprises a coupling portion and a gripping portion, each said coupling portion comprising a bore extending therethrough and sized to receive said shaft therethrough, each said gripping portion extending outwardly from each said coupling portion.

25. A rescue tool in accordance with claim 19 further comprising a collar configured to couple with said shaft and to at least one of said first arm and said second arm.

26. A rescue tool in accordance claim 25 wherein said collar is further configured to threadingly couple with at least one of said first arm and said second arm.

27. A rescue tool in accordance with claim 25 wherein said collar is further configured to limit an amount of travel of at least one of said first arm and said second arm.

28. A rescue tool for use with a extrication ram device, said rescue tool comprising a shaft and at least one arm slidably coupled to said shaft, said rescue tool configured to engage a structure and provide a brace for the ram device during operation of the ram device against the structure, said rescue tool further configured to remain secured to the structure during operation of the ram device, said at least one arm comprising an inner face and an outer face, each of said inner and outer faces comprising a plurality of teeth, said teeth extending substantially along a length of said inner face.

29. A rescue tool in accordance with claim 28 wherein at least one of said inner face and said outer face plurality of teeth is configured to contact the structure during operation of the ram device.

30. A rescue tool in accordance with claim 29 wherein said at least one arm is configured to travel along said shaft in a direction substantially parallel to an axis of symmetry of the shaft.

31. A rescue tool in accordance with claim 29 wherein said at least one arm extends substantially perpendicularly from said shaft.

32. A rescue tool in accordance with claim 28 wherein at least one of said inner face and said outer face is configured to provide a brace for the ram device during operation of the ram device against the structure.

33. A rescue tool in accordance with claim 28 wherein said at least one arm further comprises a pair of opposing arms slidably coupled to said shaft, said arms substantially parallel.

34. A rescue tool in accordance with claim 28 further comprising a collar configured to couple with said shaft and at least one arm for moving said arm with respect to said shaft.

35. A rescue tool in accordance with claim 28 further comprising a collar configured to control an amount of travel of said at least one arm.

36. A rescue tool in accordance with claim 28 further comprising a collar configured to position said at least one arm against the structure.

37. A rescue extrication system comprising:

a hydraulic ram comprising a first end and a second end; and a rescue tool configured to coupled to a structure during an extrication to provide structural support for said hydraulic ram, said rescue tool comprising a body and a pair of opposing arms, at least one of said pair of opposing arms slidably coupled to said body, each said arm comprising an inner face and an outer face, said first arm inner and outer face comprising a plurality of teeth, wherein said plurality of teeth extending along said first arm inner face extend substantially between a radially outer tip of said face and said body, said at least one of said second arm inner and outer face comprises a plurality of teeth.

38. A system in accordance with claim 37 wherein said opposing arms are configured to contact the structure such that said tool is secured in position with respect to the structure, to provide a bracing support for said ram.

39. A system in accordance with claim 38 wherein each said rescue tool arm inner face and outer face comprises a plurality of teeth, said opposing arms are substantially parallel and extend substantially perpendicularly from said rescue tool body.

40. A system in accordance with claim 39 wherein said rescue tool further comprises a collar configured to couple with said body and with at least one of said pair of opposing arms.

41. A rescue tool in accordance with claim 40 wherein said collar configured to limit an amount of travel of at least one of said opposing arms.

42. A method of emergency extrication from a structure with a rescue tool, said method comprising:

providing a rescue tool including a body and a pair of arms coupled to the body and extending outwardly from the body, wherein each at least one arm includes an inner face including a plurality of teeth, and an outer face including a plurality of teeth, wherein the teeth extending along the inner face extend substantially from the body to a tip of the arm;

adjusting at least one of the pair of arms plurality of teeth contacts the structure; and performing the extrication from the structure.

43. A method in accordance with claim 42 wherein adjusting at least one of the pair of arms further comprises slidably adjusting a position of at least one of the arms with respect to the tool body, such that the arm is moved in a direction that is substantially parallel to an axis symmetry of the tool body.

44. A method in accordance with claim 42 wherein adjusting at least one of the pair of arms further comprises slidably adjusting a position of at least one of the arms with respect to the tool body, such that the arms remain substantially parallel with respect to each other, and remain substantially perpendicular with respect to the tool body.

45. A method in accordance with claim 42 wherein adjusting at least one of the pair of arms further comprises slidably adjusting a position of each arm respect to the tool body, such each arm is moved in a direction that is substantially parallel to an axis of symmetry of the tool body.

46. A method in accordance with claim 42 wherein adjusting at least one of the pair of arms further comprises adjusting a position of at least one arm using a collar coupled to the tool body and to the arm being adjusted.

47. A method in accordance with claim 42 wherein adjusting at least one of the pair of arms further comprises limiting an amount of travel of at least one arm by adjusting a collar coupled to the tool body and to at least one arm.

48. A method in accordance with claim 42 wherein performing the extrication from the structure further comprises coupling the rescue tool to the structure such that at least a portion of the structure is in between the opposing arms and in contact with an inner face of each arm.

49. A method in accordance with claim 48 wherein performing the extrication from the structure further comprises bracing an extrication ram device against the rescue tool and in contact with the structure.

50. A method in accordance with claim 48 wherein performing the extrication from the structure further comprises coupling a winch to the rescue tool.

51. A method in accordance with claim 42 wherein performing the extrication from the structure further comprises positioning the rescue tool such that at least a portion of the structure is contacted by an outer face of at least one arm.

52. A method in accordance with claim 51 wherein performing the extrication from the structure further comprises increasing a distance between the opposing arms such that at least a portion of the structure is forcibly moved by the rescue tool.

* * * * *

UNITED STATES PATENT AND TRADEMARK OFFICE

CERTIFICATE OF CORRECTION

PATENT NO. : 6,722,176 B2
DATED : April 20, 2004
INVENTOR(S) : Cerrano et al.

It is certified that error appears in the above-identified patent and that said Letters Patent is hereby corrected as shown below:

Column 12,
Line 50, delete “coupled” and insert therefor -- couple --.

Column 13,
Line 20, between “arms” and “plurality” insert -- such that the --.
Line 27, between “axis” and “symmetry” insert -- of --.

Column 14,
Line 1, between “arm” and “respect” insert -- with --.
Line 2, between “such” and “each” insert -- that --.

Signed and Sealed this

Twenty-ninth Day of June, 2004

JON W. DUDAS
*Acting Director of the United States Patent and Trademark Office*